United States Patent [19]

Fijimoto

[11] Patent Number: 4,615,336

[45] Date of Patent: Oct. 7, 1986

[54] AUTOMATIC MASSAGING MACHINE

[75] Inventor: Shinichiro Fijimoto, Osaka, Japan

[73] Assignee: Fuji Medical Instruments Mfg. Co., Ltd., Osaka, Japan

[21] Appl. No.: 556,648

[22] Filed: Nov. 30, 1983

[51] Int. Cl.[4] ..... A61H 7/00

[52] U.S. Cl. ..... 128/52; 128/57; 128/44; 74/810

[58] Field of Search ..... 128/52, 55, 57, 44–51; 74/810

[56] References Cited

U.S. PATENT DOCUMENTS

| | | | |
|---|---|---|---|
| 4,009,710 | 3/1977 | Inada | 128/44 |
| 4,079,732 | 3/1978 | Shinichiro | 128/57 |
| 4,149,531 | 4/1979 | Tanaka et al. | 128/57 |
| 4,412,534 | 11/1983 | Hamabe et al. | 128/52 |

FOREIGN PATENT DOCUMENTS

| | | | |
|---|---|---|---|
| 628021 | 10/1927 | France | 74/810 |
| 1440872 | 6/1976 | United Kingdom | 74/810 |

*Primary Examiner*—Richard J. Apley
*Assistant Examiner*—David J. Brown
*Attorney, Agent, or Firm*—Koda and Androlia

[57] ABSTRACT

An automatic massaging machine is capable of giving various kinds of massage, adapted to massage the human back in different massage modes such as rub-down, patting, rolling, rubdown-rolling, and patting-rolling. The massaging machine includes two electric motors. One motor rotates a shaft in either direction so as to provide an up-and-down motion to an elevating plate including massaging balls. The other motor actuates one of two output shafts, each causing different motion to the massaging balls. An automatic switching device in the massaging machine includes three switches to control the rotation of the two motors and thereby achieves the various massage modes.

4 Claims, 8 Drawing Figures

AUTOMATIC MASSAGING MACHINE

BACKGROUND OF THE INVENTION

1. Field of the Invention

The present invention relates to an automatic massaging machine and more particularly to a chair-type massaging machine performing various kinds of massages.

2. Prior Art

Conventional chair type automatic massaging machine has a motor for rotating a vertical screw shaft in a positive or negative direction to move the drive section containing the massaging balls up and down and a motor for driving the massaging balls housed inside of the drive section on the inclined part thereof. These two motors operate to permit the massaging balls to select their own position or to be fixed, performing the desired rubdown massage or patting massage.

Recently disclosed is a roller type massaging machine which causes a pair of left and right rotational rollers, arranged in place of the conventional massaging balls, to be continuously moved upward. This roller type massaging machine is designed to produce a "chiropractic" effect by automating the upward motion of the above-mentioned pair of rollers, while they are maintained in contact with the back of the human body, specifically the backbone or its adjacent places.

In spite of this development, the conventional automatic massaging machine has not yet reached the sophisticated level covering the overall range of application including the rubdown massage, patting massage and rolling massage, let alone the rolling massage at the same time of having the foregoing massaging balls engaged in the massaging and patting motion.

SUMMARY OF THE INVENTION

The principal purpose of the present invention is to provide an automatic massaging machine capable of performing various ranges of massage with a construction enabling the elevating plate equipped with the massaging balls to be automated in its continuous upward motion and, at the same time, capable of ascending or descending motion as desired, and of having the above-mentioned massaging balls engaged optionally in massaging or patting motion, when the above-mentioned elevating plate is moving upward or at rest.

The automatic massaging machine of the present invention is equipped with a screw shaft rotatable in the positive and negative direction actuated by the first motor; an elevating plate capable of moving upward in screw contact with the above-mentioned screw shaft; a drive device actuating two output shafts, connected to a support rod holding a pair of massaging balls rotatably arranged on the elevating plate in a manner such that they are capable of two kinds of actuation mode by selecting operation between the positive and negative rotation of the second motor and the automatic switching device for selecting the direction which obtains at the starting and finishing points moving the elevating plate so that the elevating plate may be continuously or optionally moved, while being moved upward, adapting the above-mentioned first motor and second motor in combination or independently, to be operated so as to perform a rubdown massage, a patting massage, a rolling massage, a rolling-rubdown massage and a rolling-patting massage in separate ways.

DETAILED DESCRIPTION OF THE INVENTION

The preferred embodiment of the automatic massaging machine according to the present invention may be described in detail by referring to the accompanying drawings.

Figure 1:
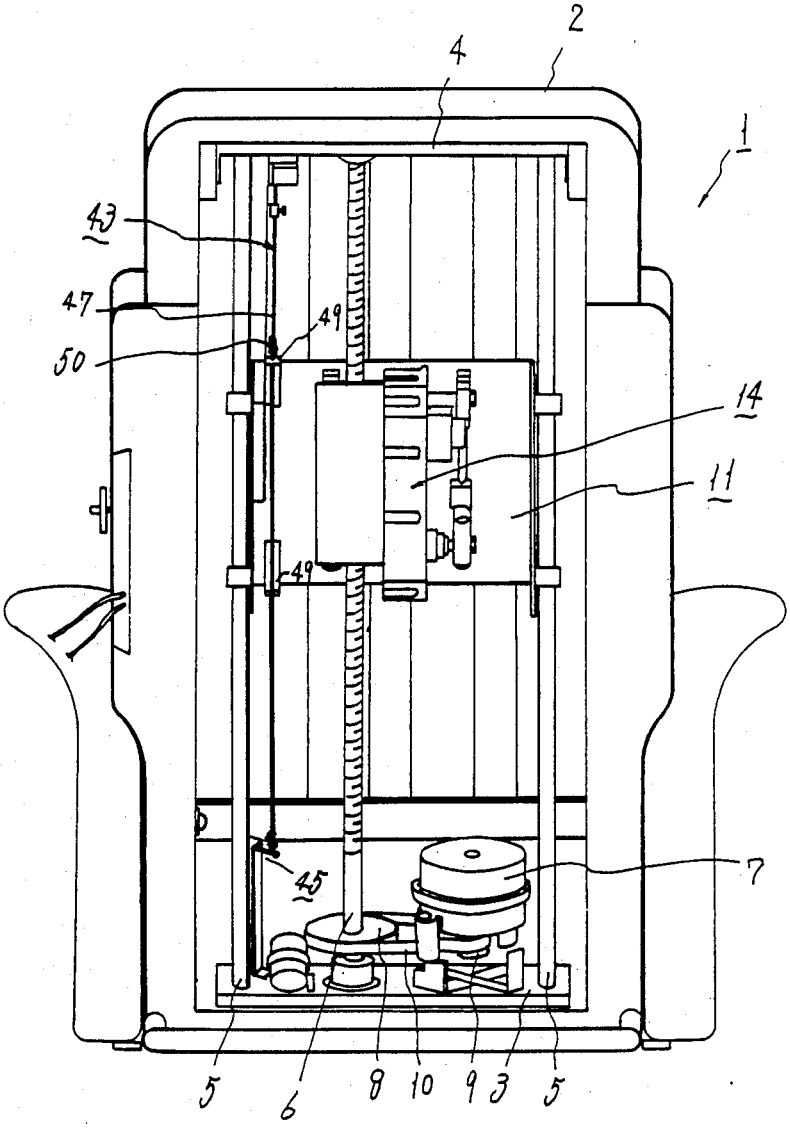
FIG. 1 is an explanatory view of the massaging machine of the present invention.
Figure 2:
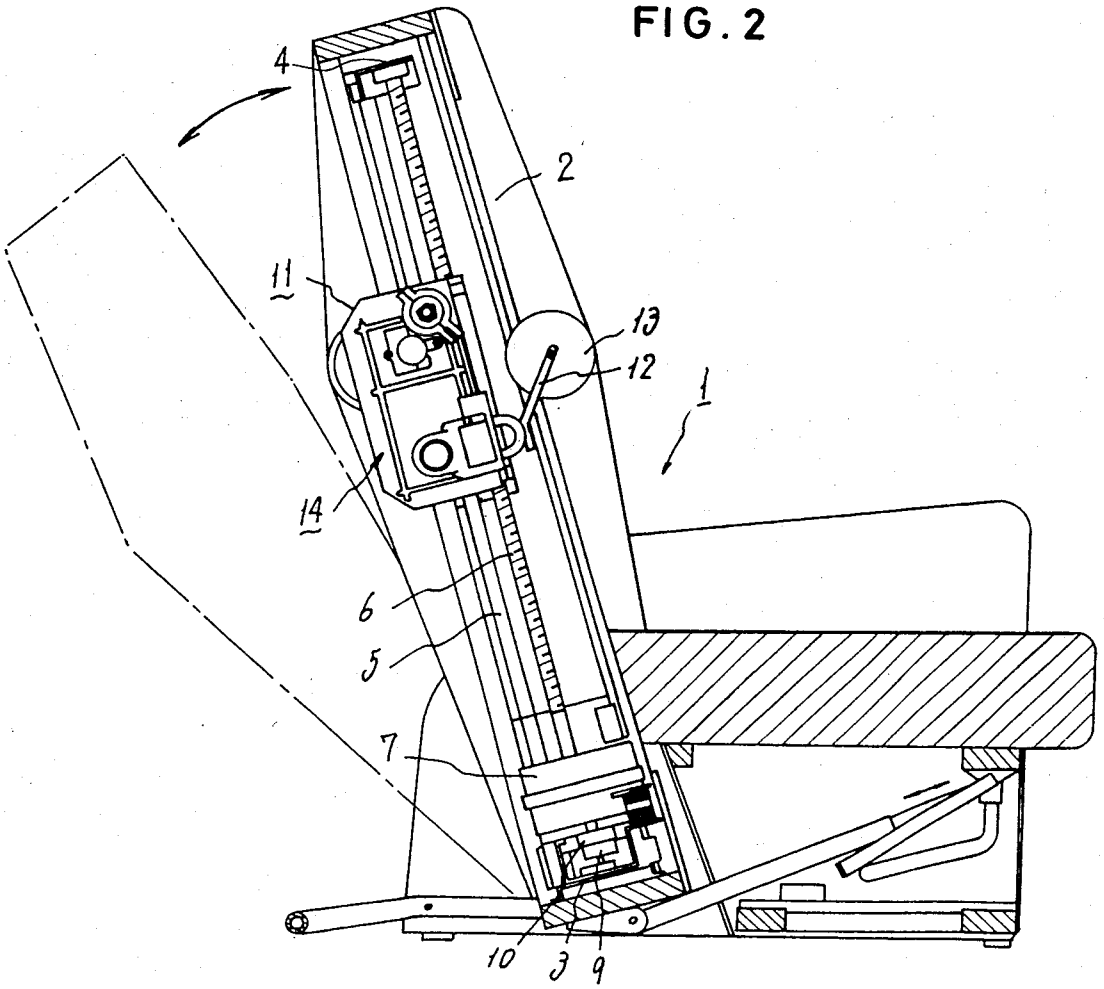
FIG. 2 is a side sectional view thereof.

In FIGS. 1 and 2 the automatic massaging machine 1 of the present invention, having a wide range of massaging functions, includes a pair of vertical parallel support pipes 5 extending between a base plate 3 and a top board 4 inside the reclining section 2.

A screw shaft 6 can be rotated in a positive or negative direction through being connected to the first motor 7. The lower part of the screw shaft 6, which is in parallel with and between the support pipes 5, is equipped with a pulley 8 for rotating the screw shaft 6. The pulley 8 is connected through a V-belt 10 to a motor pulley 9 mounted on the first motor 7, whereby the positive and negative rotation of the first motor 7 is transmitted to the screw shaft 6.

The elevating plate 11 is in screwable contact with the screw shaft 6 and, at the same time, can be moved upward while being slidably attached to the support pipes 5. The elevating plate 11 is equipped with a pair of massaging balls 13 rotatably held by a pair of support rods 12 at the left and right sides, respectively.

Figure 3:
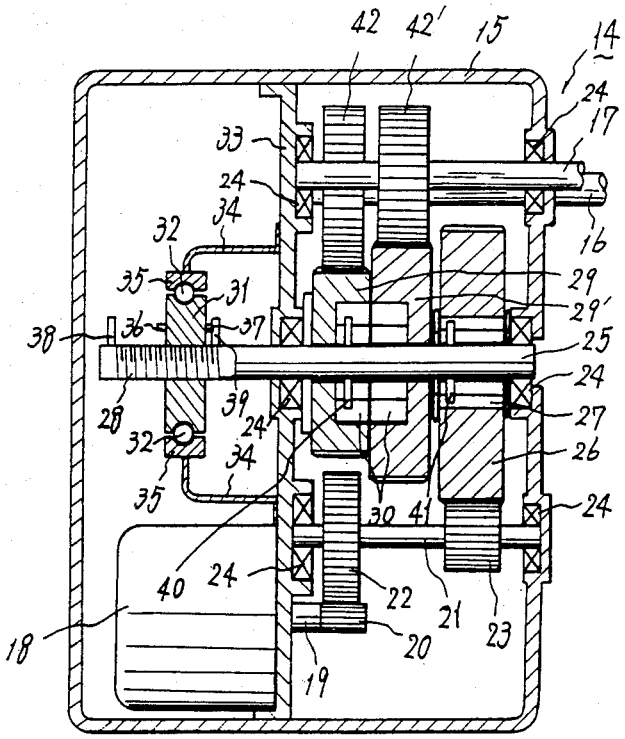
FIG. 3 is an enlarged sectional view of the drive device used in the present invention.

Numeral 14 is a drive device for imparting to the massaging balls 13 two different kinds of actuation. As shown in FIG. 3, the drive section 14 is constructed such that it can be changed over by the positive and negative rotation of the second motor 18 secured inside a gear box 15, whereby output shafts 16 and 17, for rotatingly driving the support rods 12 having massaging balls 13, are driven.

Figure 4:
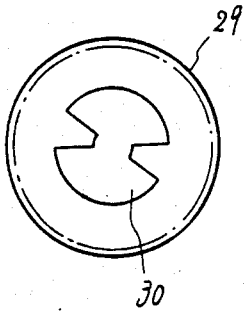
FIGS. 4(*a*), 4(*b*) and 4(*c*) are explanatory views of the groove sections of the inverted gears used in the drive device of the present invention.
Figure 4:
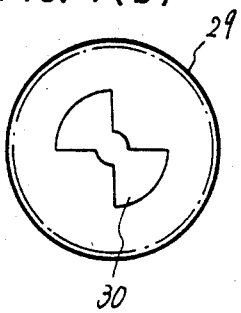
Figure 4:
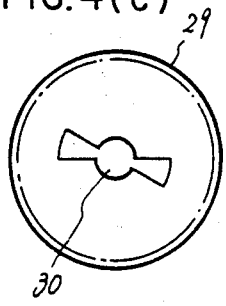

The drive section 14 includes a motor gear 20 mounted on the end of a rotational shaft 19 of the second motor 18. A transmission shaft 21 for transmitting the rotation of a gear 22 of a larger diameter engaged with the motor gear 20, through a gear 23 of smaller diameter mounted at the other end of the shaft 21, to a main drive shaft 25 which will be described later. A main drive gear 26, equipped with a drum-shaped hole 27 and in engagement with the gear 23, is pivotally mounted on one end of the main drive shaft 25. A screw portion 28 is formed on the other end of the shaft 25. Two gears 29 and 29', which differ from each other in diameter, provided with drum-shaped groove section 30 on their central parts, respectively, as shown in FIGS. 4(*a*), 4(*b*) and 4(*c*), are rotatably mounted on the central section of the main drive shaft 25. The gears 29 and 29' are in such a manner that the groove sections 30 are correspondingly opposite to each other. Pulley 31 is in a screw contact with the screw portion 28, and the outer circumference of the pulley 31 is attached via balls 32 to support pieces 35 which are spring-supported by flat springs 34 secured to partition 33. The pulley 31 supports the main drive shaft 25 in a flexible manner. Further, pins 36 and 37 are provided on opposite faces of the pulley 31. The pins 36 and 37 make a contact with fixed pins 38 and 39 provided at the beginning and the end of the screw portion 28 of the main drive shaft 25, when the main drive shaft 25 supported by bearings 24 moves axially relative to the pulley 31 to which the shaft 25 is screwably connected over its screw portion 28.

Pin 40 is provided radially on the main drive shaft 25 so as to fit into the groove section 30 of the gears 29 and 29'. A drive pin 41 contacts slidably with the inside of the hole 27 of the main drive gear 26.

Output gears 42 and 42' are provided at the ends of the two output shafts 16 and 17 such that these output gears 42 and 42' come into engagement with the gears 29 and 29', respectively.

The positive or negative rotation of the second motor 18 is transmitted through the motor shaft 19, gear 20, gear 22 of larger diameter, gear 23 of smaller diameter, and the main drive gear 26 to the main drive shaft 25. The screw portion 28 of the main drive shaft 25 moves the main drive shaft 25 axially so that the pin 40 moves between the groove sections 30 provided on the gears 29 and 29'. Specifically, if the pin 40 contacts with the groove 30 of the gear 29, this gear 29 engages the output gear 42 and rotates the output shaft 16. But if the pin 40 moves to make a contact with the groove section 30 of the gear 29', this gear 29' engages the output gear 42' and rotates the other output shaft 17.

Figure 5:
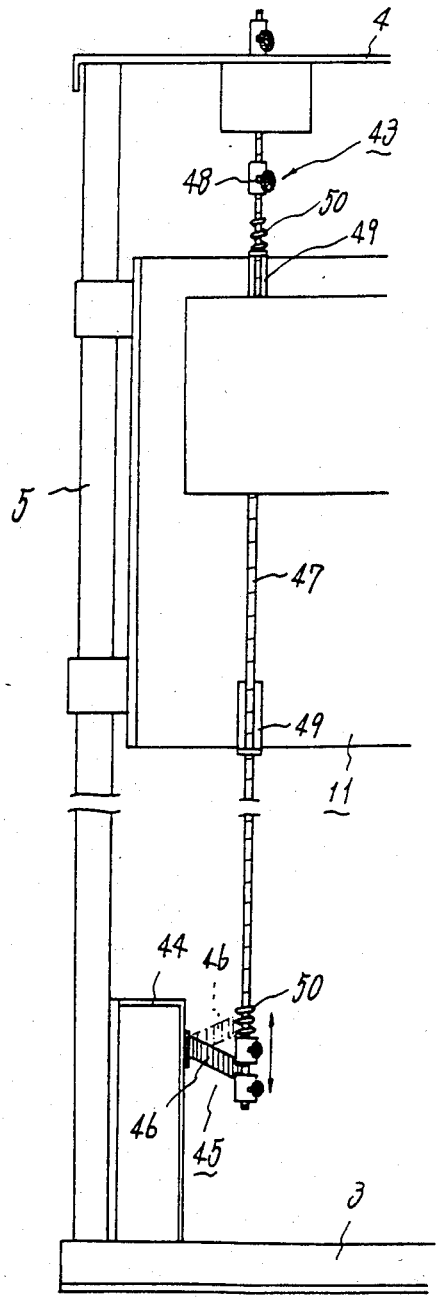
FIG. 5 is an explanatory view of the automatic switching device used in the present invention.

FIG. 5 shows an embodiment of the automatic switching device 43 for selecting the direction of the motion at the start and end points of the elevating plate 11 so that the elevating plate 11 may move continuously or optionally upwards. Device 43 includes a support plate 44, equipped with an inclined change-over switch 45 for changing the rotational direction of the motor 7 on the base plate 3; and a cable 47, equipped with an elevating plate stop 48 at the upper part thereof. The cable 47 is stretched between an inclined rod 46 of the inclined change-over switch 45 and the top board 4. The cable 47 pulls up the inclined rod 46, when the elevating plate 11 reaches the end of its upward motion to contact the stop 48 and pushes down the inclined rod 46 with which the elevating plate 11 is in contact, when the elevating plate reaches the end of its downward motion, changing the rotational direction of the first motor 7, and also, changing the rotational direction of the screw shaft 6.

Numeral 49 in FIG. 1 is a fitting for mounting the change-over switch 45 provided at each extreme position of the wire 47 between the lower part and the upper part of the elevating plate 11. An impact-absorbing spring 50 is provided on each end of the wire 47, i.e. between the fitting 49 and the inclined switch 45, and between the fitting 49 and the stop 48.

Figure 6:
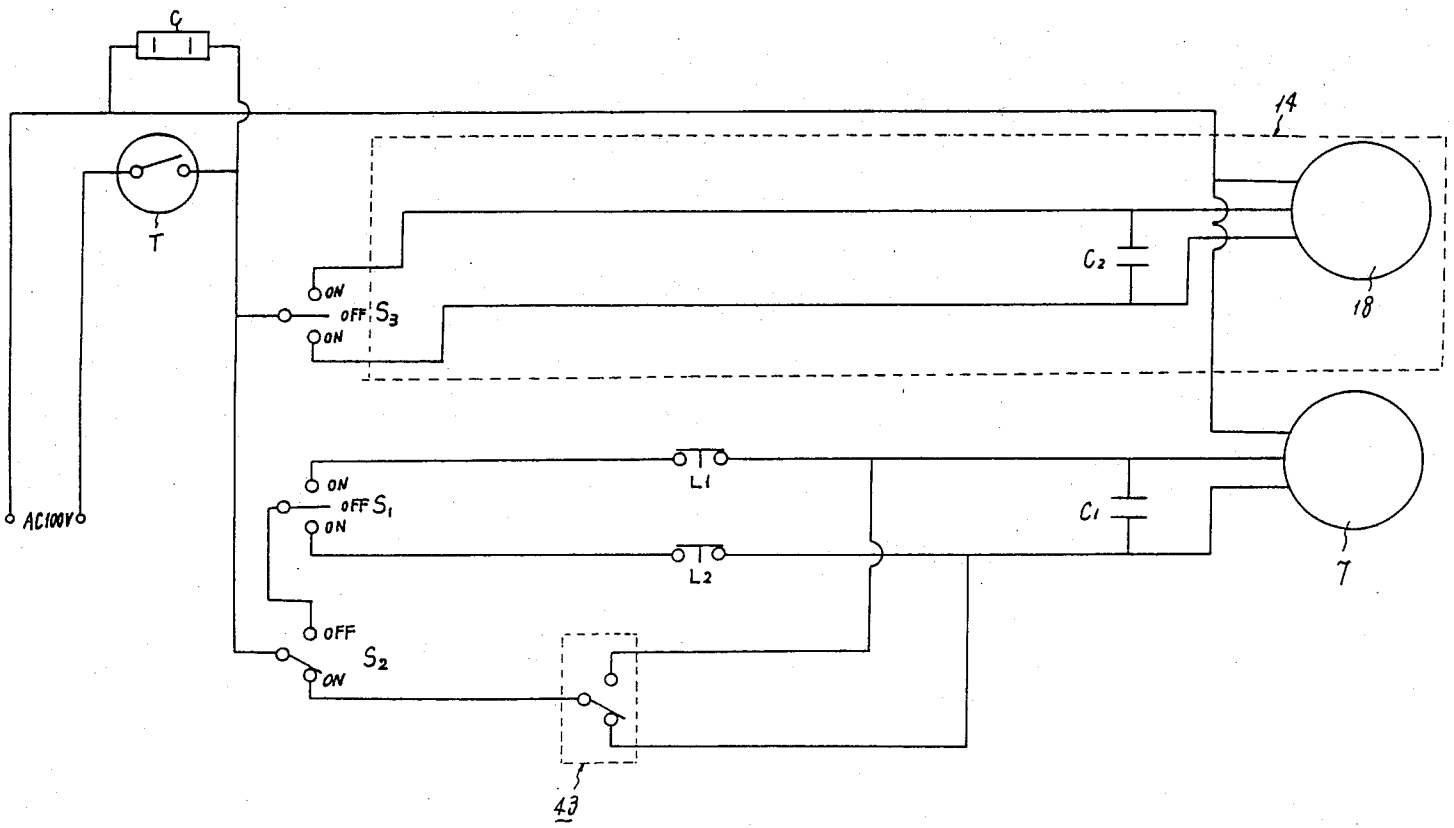
FIG. 6 is a wire diagram of the present invention.

A preferred embodiment of the automatic massaging machine according to the present invention, as detailed above, is described in reference to the wiring diagram of FIG. 6 which comprises a time base T, a plug socket C, limit switches $L_1$ and $L_2$ and condensers $C_1$ and $C_2$.

FIG. 6 shows an elevating motion switch $S_1$ for optionally elevating the elevating plate 11, a continuous elevating switch $S_2$ for continuously changing the direction of the elevating plate 11 when it reaches the start or end of its motion, elevating plate 11 being connected to the automatic switching device 43, and a drive switch $S_3$ for actuating the drive device 14 which causes the massaging balls 13 mounted on the elevating plate 11 to alternately engage in one of two kinds of motion, for example, the massaging motion or the patting motion.

When the machine is connected to an electric power source (e.g. 100 V), the drive switch $S_3$ is turned OFF and, at the same time, the continous elevating switch $S_2$ is turned ON. The elevating plate 11 then automatically changes its direction at the start and end of its motion and continues to make an ascent or a descent, applying the rolling massage to the back of the human body. In the above mode, when the drive switch $S_3$ is turned to one of the ON sides, the positive rotation or the negative rotation of the second motor 18 causes the machine to perform a patting motion, resulting in a rolling-patting massage to the back of the human body. When the drive switch $S_3$ is turned to the other ON side, the positive rotation or the negative rotation of the second motor 18 causes the machine to make a rubdown motion, while the rolling-rubdown massage is being applied.

Furthermore, when the continuous elevating switch $S_2$ is turned OFF, a circuit is connected to the elevating removal switch $S_1$ which moves the elevating plate 11 in an optional direction, and when turned ON, the elevating removal switch $S_1$ is connected to the circuit in which it is optionally free to select an ascent or a descent through the first motor 7 rotating in a positive or negative direction. As a result, the elevating plate 11 can be moved to any position on the back of the human body. For example, when the elevating plate 11 is positioned to the uppermost or the lowest part, the actuation of the limit switch $L_1$ or $L_2$ automates the stopping of the elevating plate 11. Then, after positioning the elevating plate 11 at the predetermined location on the back of the human body, the drive switch $S_3$ is turned ON so as to rotate the second motor 18 in a positive or negative direction, thereby applying the desired patting massage or rubdown massage to the back of the body.

It will be apparent from the foregoing embodiment that in the automatic massaging machine of the present invention, the elevating plate equipped with the balls makes an automatic continuous upward motion an optional ascending motion, and a descending motion. Further the machine enables the massaging balls to optionally perform a patting motion and rubdown motion when the elevating plate is in motion or at rest. In addition to being able to perform the rolling-rubdown massage and the rolling-patting massage, which cannot be obtained by the existing automatic massaging machine, the machine of the present invention can still perform the conventional type of rolling massage, rubdown massage and patting massage. The machine is also capable of optionally providing any of these massage modes to relieve the stiffness and tiredness in the back of the human body. The machine performs the kind of massage suitable for various symptoms, and is very useful in getting rid of stress.

While the within invention has been described in terms of a rolling, patting or rub down massage, the invention does not lie in the type of massage or the mechanism for performing the massage and any conventional device producing any type of conventional massaging effect could be utilized in this invention. In particular the invention resides in the drive section 14 which includes a change over mechanism.

The automatic switching device for selecting the direction of the motion of the automatic massaging machine according to the present invention is not limited to the foregoing embodiment. It may be, for example, possible to alter the inclined rods mounted at the start and end of the motion of the elevating plate 11, for changing over the rotational direction of the first motor 7 to the positive or negative, and causing the reverse direction of the elevating plate motion.

The drive device 14 is not limited to the foregoing embodiment too. It is needless to say that the use of the clutch mechanism or other means can adapt the massaging balls to perform two kinds of action.

I claim:

1. An automatic massaging machine comprising:

a first motor;

a screw shaft to be rotated in a positive or negative direction driven by said first motor;

an elevating plate which can make ascending and descending motion, in a screw contact with said screw shaft;

a second motor;

a driving device coupled to said second motor, said driving device comprising:

two output shafts;

a power transfer shaft which is driven by said second motor, said power transfer shaft being shiftable;

a first gear means rotatably provided on said power transfer shaft for driving one of said two output shafts;

a central groove provided in said first gear means;

a second gear means rotatably provided on said power transfer shaft for driving an other of the two output shafts;

a central groove provided in said second gear means; and a pin provided in said power transfer shaft which engages said central groove in said first gear when said power transfer shaft is shifted to one position and which engages with said central groove in said second gear means when said power transfer shaft is shifted to another position;

a pair of massaging balls;

a connecting means rotatably supporting said massaging balls and arranged on said elevating plate and driven by said two output shafts such that said balls perform one type of massage motion in response to a one of said two output shafts being driven and another type of massage motion in response to the other of the two output shafts being driven;

a means for shifting said power transfer shaft in response to positive or negative rotation of said second motor; and an automatic switching device for reversing a direction of motion at the start and finish of the motion of the elevating plate by causing the first motor to drive said screw shaft in a positive or negative direction of rotation.

2. An automatic massaging machine according to claim 1, in which said means for shifting said power transfer shaft comprises a screw thread portion formed on one end of said power transfer shaft, a pulley threaded on said screw thread portion, two stops affixed to said screw thread portion, one on each side of said pulley, to thereby provide corresponding limits to shifting motion of said power transfer shaft.

3. An automatic massaging machine according to claim 1, in which said automatic switching device comprises a first switch means coupled to said first motor for reversing the directions of motion of the elevating plate.

4. An automatic massaging machine according to claim 3, further comprising a second switch for selecting continuous vertical motion of said elevating plate and a third switch for actuating said driving device such that said massaging balls are engaged in one of said two kinds of massage motion.

* * * * *